United States Patent [19]

Morse

[11] 4,229,006

[45] Oct. 21, 1980

[54] MAZE PUZZLE

[76] Inventor: Harold Morse, 1445 S. Pearl, Denver, Colo. 80210

[21] Appl. No.: 53,093

[22] Filed: Jun. 28, 1979

[51] Int. Cl.[3] ..... A63F 9/08

[52] U.S. Cl. ..... 273/153 S; 273/111

[58] Field of Search ..... 273/153 S, 157 R, 109, 273/111

[56] References Cited

U.S. PATENT DOCUMENTS 741,287 10/1903 Taylor ..... 273/109

845,845 3/1907 Bennett ..... 273/109

*Primary Examiner*—Anton O. Oechsle

*Attorney, Agent, or Firm*—Richard D. Law

[57] ABSTRACT

A gameboard, having a recessed playing area, with a series of pivoted shapes, each being a portion of a geometrical shape, secured in spaced relation in the recessed area, and a freely movable, mating piece for each geometrical shape, provides a maze having the object to move randomly placed free pieces to their mating pivoted pieces.

10 Claims, 7 Drawing Figures

MAZE PUZZLE

This invention relates to a puzzle game, testing the players' skill in visual accuity and geometrical acumen, having flat playing pieces, one half of which are of a predetermined shape and are pivotally mounted in a recessed area of a playing board. The other half of the playing pieces are individual mating pieces for one of the pivoted pieces, and are freely movable about the recessed area. The shape of the recessed area and the pivoted pieces control movement of the free pieces, providing passages around the playing area.

PRIOR ART

An early puzzle, patented to Hubbard, Mar. 1, 1904 U.S. Pat. No. 753,266, shows a rectangular board with a slot bisecting the playing surface. A rotary disc, with a mating slot to the board slot, bisects the slot. Square playing pieces are movable along the slots, and two pieces may be placed in the slot in the disc, to transfer pieces from one side to the other side of the disc by rotating the same.

Reuger, U.S. Pat. No. 437,002, issued Sept. 23, 1890 discloses a square block with a single disc centrally of the block. The block has a playing piece track on its periphery for a series of square pieces which completely fill the track. The disc has a slot for one piece, and each side of track has one central entrance to the disc, so that a piece may be transferred from one side of the peripheral track to either of the other three sides.

Dow, U.S. Pat. No. 560,197 issued May 19, 1896 shows a circular playing board for a puzzle having a shaped track somewhat peripherally of a central pivoted disc. The disc has a series of different sized indents for moving uniform size discs from one portion to another portion of the track.

U.S. Pat. No. 1,275,210 to Braunschweiler of Aug. 13, 1918 shows a playing board with a triangular track, the hypotenus of which has linear track extensions, and pivoted disc at the triangle apex provides transfer of rectangular playing pieces from side to side of the triangular track, thereby changing the positions of the pieces.

Ellman, U.S. Pat. No. 2,948,535, issued Aug. 9, 1960 shows a puzzle with a board having a plurality of slots that intersect in a central area, and a plurality of pieces secured in the slots, but movable therealong, may be arranged in particular positions in the central area to form pictures.

A maze is shown in U.S. Pat. No. 3,539,190 issued Nov. 10, 1970 to Redo has a rectangular board with a series of pins at spaced intervals forming various paths along which a token may be pushed, with some path accepting the token and some do not.

OJBECTS AND ADVANTAGES OF THE INVENTION

Included among the objects and advantages of the invention is to provide a puzzle in the form of a maze having a playing board, pivoted piece fixed to the board and a freely movable, mating piece for each pivoted piece.

Another object of the invention is to provide a maze-puzzle providing the combination of a recessed playing surface with fixed and pivoted pieces with a mating free piece for each pivoted piece permitting some limited movement and some stopping of the free pieces.

Yet another object of the invention is to provide a maze having a recessed area of a predetermined configuration, a plurality of fixed but pivoted pieces and a mating piece for each pivoted piece providing resisted travel around the playing area by the free pieces, from random starting positions to mating position with each mate.

Still another object of the invention is to provide a maze having a predetermined shaped playing area, a series of geometrically shaped pivoted pieces and a mating, freely moving piece for each pivoted piece, arranged with a resistive passage for the free pieces attempting to mate each free piece with its mate.

An additional object of the invention is to provide a recessed playing board, fixed but pivoted pieces and free pieces each having a mate with one of the pivoted pieces, so that the free pieces may be moved around resisted passages without lifting the same from the board.

A further object of the invention is to provide a game maze having plural pivoted pieces fixed to the game board and one mating free playing piece for each pivoted piece arranged so that in some cases at least two free playing must interact to pass a pivoted piece.

A still further object of the invention is to provide a game maze having plural pivoted playing pieces fixed to a game board and one mating free playing piece for each pivoted piece, where each mating set has a particular predetermined shape so as to operate in a particular manner including free pieces passing pivoted pieces singly or in concert with another free piece in a type of a chain reaction.

These and other objects of the invention may be ascertained by reference to the following description and illustrations.

GENERAL DESCRIPTION OF THE DRAWINGS

Figure 4:
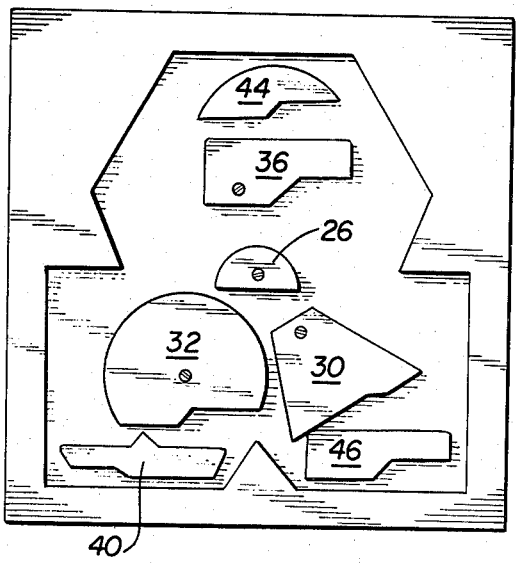
Figure 5:
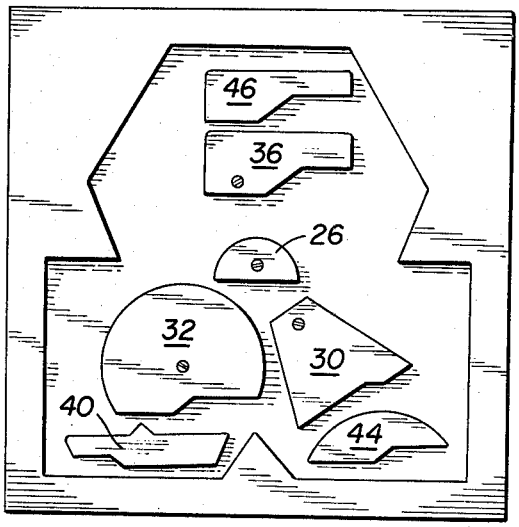
Figure 6:
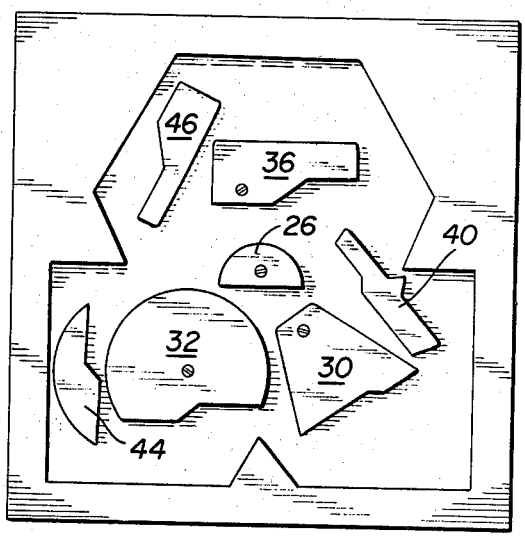

FIGS. 4, 5, and 6 are plan views of the maze-puzzle, according to the invention, showing various starting positions of the free pieces.

Figure 7:
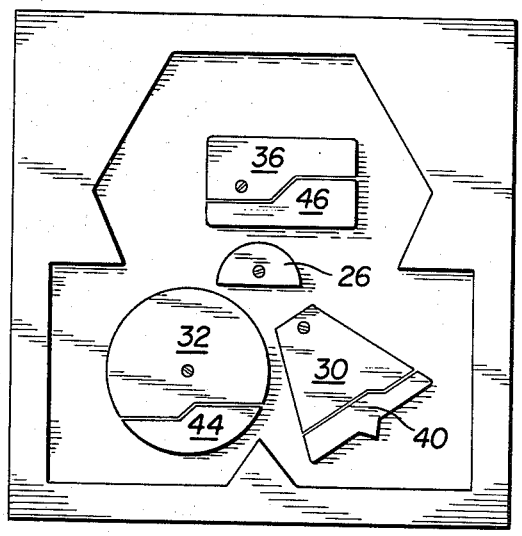

FIG. 7 is a top plan view of the solution of the puzzle.

SPECIFIC DESCRIPTION OF THE DRAWINGS

In general, one form of the playing board of the invention includes a planar base, which may be thin plywood, rigid plastic sheet or the like, having top sheet secured thereto. The top sheet has a cut-out portion leaving a complete peripheral border around the cut-out portion, which cut-out is of a predetermined shape. This produces a recessed area for the playing pieces. In one form, the playing pieces, consist of a series of playing pieces in sets, one which is fixed but pivotal set and one which is movable set. In another form, all but one fixed but pivoted piece has a mating movable piece. When the mating pieces are combined in mating configuration they form a geometric figure. Thus, the combined pieces may produce a disc, a rectangle, an irregular heptagon, or any other desired configuration. The non-mated pivoted piece provides a barrier to the movable pieces under some conditions, but passes the pieces under other conditions.

Figure 1:
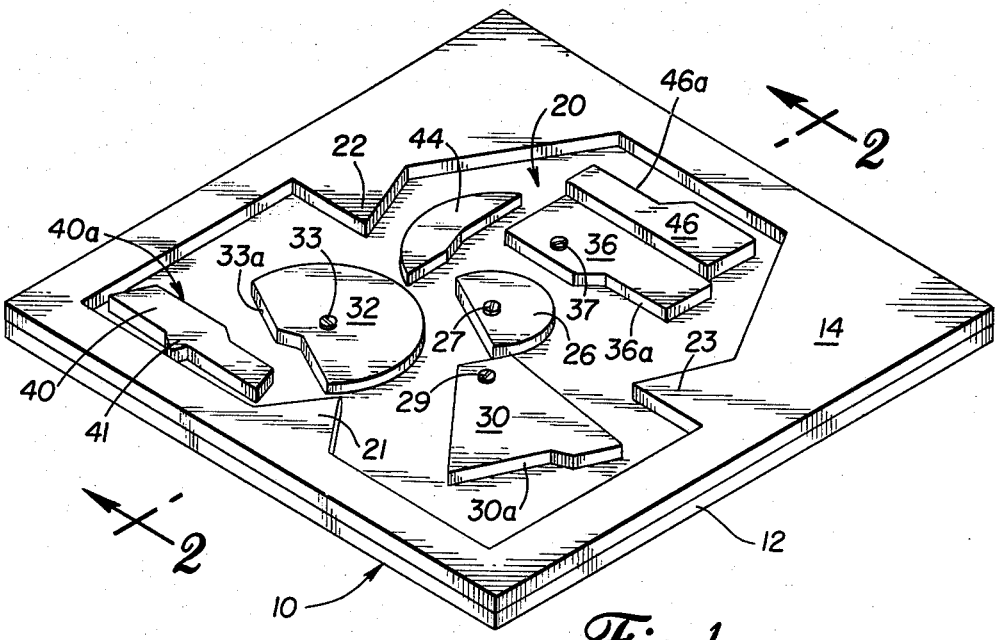
FIG. 1 is a perspective view of a maze-puzzle according to the present invention.
Figure 2:
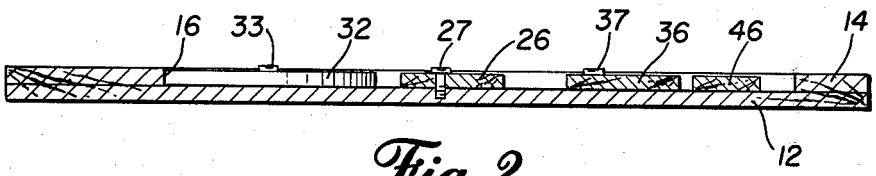
FIG. 2 is a cross-sectional view of the puzzle of FIG. 1 taken on section lines 2—2.

In the device of FIGS. 1 and 2, a playing board, shown generally by numeral 10, includes a rectangular base 12 with an overlay member 14 having a cut-out area 16 centrally of the member 14, leaving a peripheral edge completely around the cut-out. This arrangement leaves a recessed playing area, shown generally as numeral 20. The area is, roughly, a truncated triangle juxaposed with a rectangle, however, with triangular lands that extend into the cut-out portion. Thus, land 21 in the lower side of the rectangular portion and lands 22 and 23 at about the intersection of the triangular cut-out sides and the rectangular sides, provide limits to a peripheral path.

A hemispherically shaped piece 26 pivotally secured to the base 12 by a pivot pin 27 is mounted generally centrally of the cut-out area. This piece may be freely rotated 360° around the pivot pin. A truncated, somewhat triangular piece 30 pivoted on pin 29 is adjacent to the piece 26 at its lower right. Another partial circular disc member 32 is pivoted on pivot pin 33 at the lower left of the central member. An upper, somewhat rectangular piece 36 is pivotally secured to the base by pivot pin 37. All of these pivoted pieces are preferably secured to the pivot pin so as to be retained in position, but they are all free to pivot 360°.

The free pieces of the invention include a mating piece 40, for pivoted piece 30, which includes a triangular tab 41. This piece includes an edge **40*a* which mates with edge 30*a* on piece 30. When combined these pieces form an irregular heptagon. An arcuate edged piece 44 with an indented edge that mates with edge 33*a* of pivoted piece 32. When there is alignment of these two pieces, they form a circular disc. Another free piece 46 having an edge 46*a* that mates with edge 36*a* of pivoted piece 36**, together form a rectangular composite, when aligned.

Figure 3:
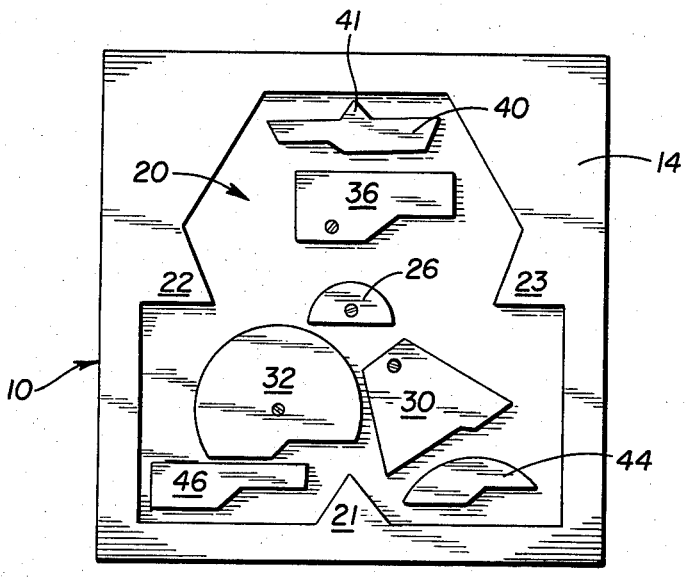
FIG. 3 is a reduced size, top plan view of the maze-puzzle of FIG. 1.

During the play of puzzle, the free pieces are not lifted, but rather are slid about the recessed playing area. The object is to mate the pieces in proper alignment, as shown in FIG. 7. Initial positions for starting may make the puzzle solutions range from easy to difficult. Thus, the easiest solution is by using a set-up as in FIG. 6, harder in FIG. 4, still harder in FIG. 5. Another set-up is shown in FIG. 3.

Regardless of the starting position, a player's goal is to unite each free piece with its respective mate in aligned position. This goal position or general solution is shown in the diagram of FIG. 7. As the free pieces are guided on the route to "solution", they create their own dynamic maze barriers.

The play begins after the initial set of the free pieces in one of the several positions. The free pieces may be slid, and turned, but are not to be lifted or twisted from the recessed surface. The configuration and geometry is such that no force is necessary to move the pieces in tight squeezes.

Generally, the height of the free pieces (the thickness of the piece) from the playing surface is the same as the pivoted pieces. Preferably, the pieces and the cut-out member are the same thickness. When made of plywood, they may be cut from the same sheet.

Obviously, other shapes of the playing may be used, and these must be shaped to permit the movement of the free pieces around the pivoted pieces. Further, the number of pieces may be changed, however, the addition of more of the two piece combinations (one pivoted and one free) greatly increases complexity. Of course, the pieces may be color coded for very young players. Other changes will be obvious to others and these are intended within the scope of the invention. The shape of the pieces as shown require that some of the pieces react conjointly to pass a particular pivoted piece in a type of chain reaction. Thus the design of the pieces is predetermined to permit the pieces to operate in a particular manner. Thus, other shapes of individual sets must be matched with the shapes of the other sets to provide the interaction.

What is claimed is:

1. A maze puzzle comprising:

(a) a playing board having a planar recessed playing area with a complete peripheral border, said playing area having a predetermined size and shape;

(b) a series of spaced, pivoted shapes, each being a portion of a geometrical configuration and mounted in said recessed area to provide a limited passage therearound for free playing pieces;

(c) a series of free playing pieces, each one of which is a complement of one of said pivoted shapes arranged to mate therewith and form a predetermined geometrical shape, and to pass around each one of said pivoted shapes in predetermined positions; and (d) at least one general central pivoted shape of small dimensions mounted on said playing area arranged as a limit to passage of said free playing pieces and being without a mating piece.

2. A maze puzzle according to claim 1, wherein said playing board includes a planar base sheet and a centrally cut-out planar sheet secured thereto, forming said recessed playing area in the cut-out area and said peripheral border.

3. A maze puzzle according to claim 2, wherein each said pivoted piece and said free piece is of the same thickness as said cut-out sheet.

4. A maze puzzle according to claim 1, wherein at least three pivoted shapes each having a free piece arranged to mate with and combine therewith to form a geometrical shape.

5. A maze puzzle according to claim 4, wherein one of said at least three combined geometrical shape is a circular disc.

6. A maze puzzle according to claim 4, wherein one of said at least three combined geometrical shape is a rectangle.

7. A maze puzzle according to claim 4, wherein one of said at least three combined geometrical shape is an irregular heptagon.

8. A maze puzzle according to claim 4, wherein said at least three combined geometric shapes are a circular disc, a rectangle and an irregular heptagon.

9. A maze puzzle according to claim 8, wherein said generally central pivoted shape is mounted centrally of said three pivoted shapes.

10. A maze puzzle according to claim 1, wherein said central pivoted shape is approximately a hemicircle.

* * * * *